US007090524B2

(12) United States Patent
Tanimoto et al.

(10) Patent No.: US 7,090,524 B2
(45) Date of Patent: Aug. 15, 2006

(54) ELECTRONIC APPARATUS WITH TWO CONNECTORS WITH A COMMON FIXING MEMBER

(75) Inventors: Mitsuyoshi Tanimoto, Sagamihara (JP); Kohei Wada, Fussa (JP); Toshikatsu Nakamura, Akishima (JP); Masayasu Tokuoka, Kodaira (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 17 days.

(21) Appl. No.: 10/819,576

(22) Filed: Apr. 6, 2004

(65) Prior Publication Data

US 2004/0259424 A1 Dec. 23, 2004

(30) Foreign Application Priority Data

Jun. 17, 2003 (JP) ..... 2003-172371

(51) Int. Cl.
*H01R 13/627* (2006.01)

(52) U.S. Cl. ..... 439/352

(58) Field of Classification Search ..... 439/350–365
See application file for complete search history.

(56) References Cited

U.S. PATENT DOCUMENTS 4,959,021 A * 9/1990 Byrne ..... 439/310
5,169,332 A * 12/1992 Cooke et al. ..... 439/304
5,197,900 A * 3/1993 Ellis et al. ..... 439/352
6,358,076 B1 * 3/2002 Haag ..... 439/320
6,736,677 B1 * 5/2004 Lin et al. ..... 439/610
6,764,344 B1 * 7/2004 Maiers ..... 439/629
6,776,665 B1 * 8/2004 Huang ..... 439/676

FOREIGN PATENT DOCUMENTS

CN 2442302 Y 8/2001
JP 07-028559 1/1995

* cited by examiner

*Primary Examiner*—Chandrika Prasad
(74) *Attorney, Agent, or Firm*—Blakely Sokoloff Taylor & Zafman, LLP

(57) ABSTRACT

An electronic apparatus includes a housing provided with first and second connectors, a first fixing member receiving element positioned on the side of the first connector opposite to the second connector side, a second fixing member receiving element positioned on the side of the second connector opposite to the first connector side, and a third fixing member receiving element positioned between the first connector and the second connector. First and second plugs are removably connected to the first and second connectors. The first fixing member receiving element fixes one fixing member of the first plug. The second fixing member receiving element fixes one fixing member of the second plug. The third fixing member receiving element fixes either the other fixing member of the first plug or the other fixing member of the second plug.

17 Claims, 3 Drawing Sheets

ELECTRONIC APPARATUS WITH TWO CONNECTORS WITH A COMMON FIXING MEMBER

CROSS-REFERENCE TO RELATED APPLICATIONS

This application is based upon and claims the benefit of priority from the prior Japanese Patent Application No. 2003-172371, filed Jun. 17, 2003, the entire contents of which are incorporated herein by reference.

BACKGROUND

1. Field

The present invention is related to an electronic apparatus, in particular to the structure for connecting external apparatuses to the electronic apparatus.

2. Description of the Related Art

A portable computer referred to as a notebook comprises a main unit including a keyboard, and a liquid crystal display unit supported by the main unit. The main unit includes a flat, box-like housing. A plurality of connectors are placed in a line at a side surface of the housing to permit connection of external apparatuses having the same function but different types of connecting portions.

Japanese Patent Application KOKAI Publication No. 7-28559 discloses such a portable computer wherein the connectors are covered to prohibit external apparatuses having the same function from being concurrently connected to the housing, and the connector covers provided to the housing permit one of the connectors to be selectively exposed.

There is a kind of plug that is used by connecting the plug body to a connector and securing the plug body to the housing by screws. Such a plug comprises a casing, a plug body, and a pair of screws provided on both sides of the plug body, and the plug body and the pair of screws are contained in the casing.

When such a plug is to be used, it is necessary to provide the housing with screw bosses on both sides of a connector. Therefore, between two adjacent connectors, a screw boss belonging to one connector and a screw boss belonging to the other connector are placed side by side. In addition, it is necessary to place adjacent connectors with a sufficient space in between to prevent the casings of plugs, respectively corresponding to the connectors, from interfering with each other when they are concurrently connected.

However, in regard to a portable computer, there is an instance where adjacent connectors are not used concurrently, such as adjacent connectors for connection of a plurality of external apparatuses having the same function but different types of connecting portions. In such an instance, these connectors do not need to be placed with a sufficient space to allow concurrent connection of their respective corresponding plugs as stated above.

Also, there is a demand for further downsizing and functional advancement of portable computers, and it is desirable that various components contained in a housing be placed at a high density. Therefore, there is a demand for reduction of the space occupied by such connectors as those that are placed adjacent to each other but are not used concurrently.

DETAILED DESCRIPTION

Figure 1:
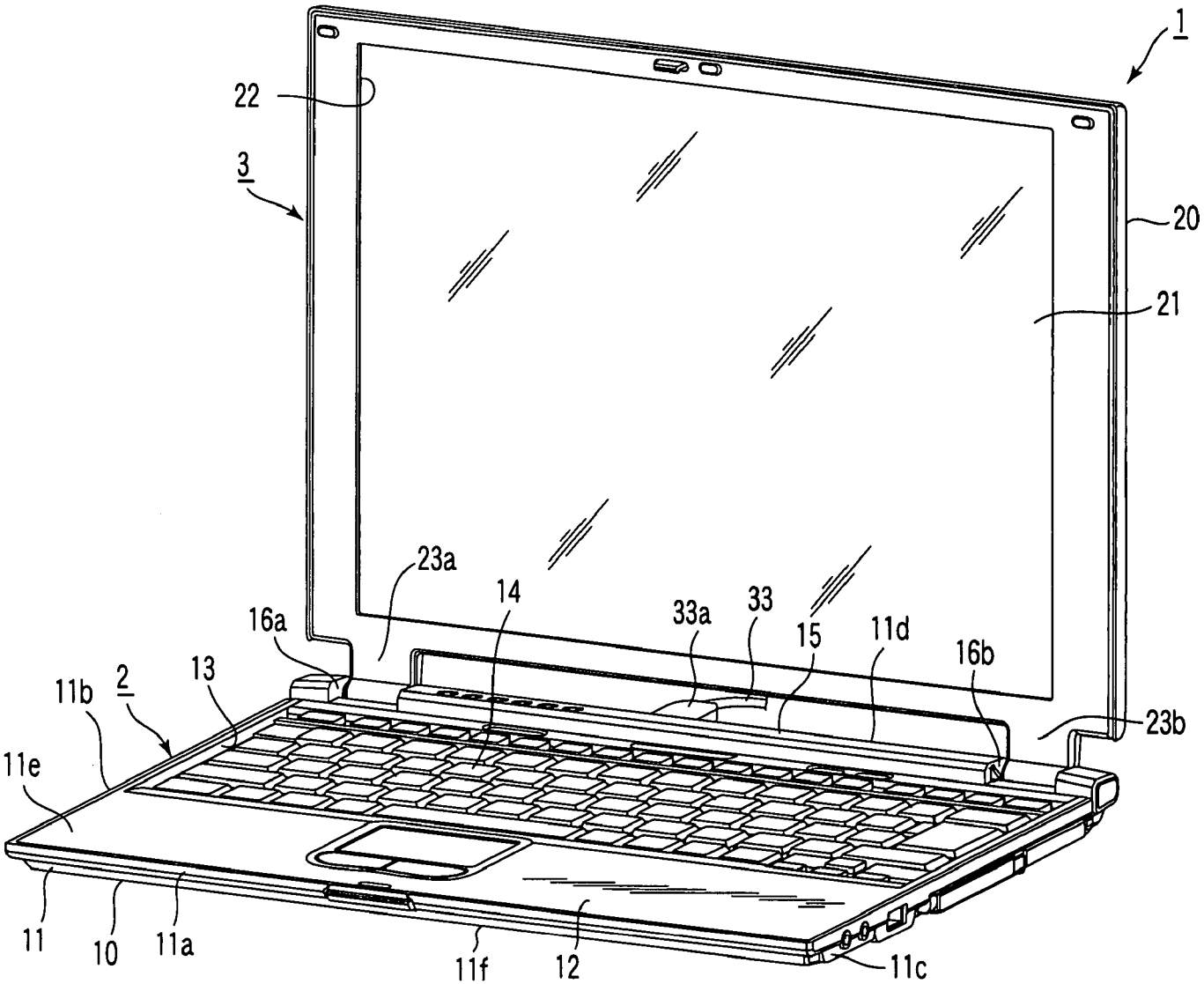
FIG. 1 is a perspective view showing a portable computer according an embodiment of the present invention.

An embodiment of the present invention will now be described with reference to FIGS. 1 to 5, wherein the present invention is applied to any electronic apparatus featuring two connectors, such as a portable computer. A portable computer 1 comprises a main unit 2 and a liquid crystal display unit 3 supported by the main unit 2.

The main unit 2 includes a housing 10, which is placed on a footprint (not shown) that is like, for example, the top of a desk. The housing 10 comprises a front wall 11*a*, right and left side walls 11*b*, 11*c*, a connector panel 11*d* that also serves as a rear wall, a top wall 11*e*, and a bottom wall 11*f*, and is shaped like a flat box.

The top wall 11*e* includes a palm rest 12 and a keyboard mounting portion 13. The palm rest 12 extends in the width direction of the housing 10 in the front half of the housing 10. The keyboard mounting portion 13 is positioned behind the palm rest 12. A keyboard 14 is mounted to the keyboard mounting portion 13.

At a rear end portion of the top wall 11*e*, a slender projecting portion 15 that juts upward is formed. The slender projecting portion 15 extends over the entire width of the housing 10 behind the keyboard 14. The rear end edge of the slender projecting portion 15 is continuous with the upper end edge of the connector panel 11*d*. In addition, the slender projecting portion 15 includes a pair of display supporting portions 16*a*, 16*b*. Each of the display supporting portions 16*a*, 16*b* comprises a depression opening frontward, upward and rearward of the slender projecting portion 15. These display supporting portions 16*a*, 16*b* are spaced apart from each other in the longitudinal direction of the slender projecting portion 15.

The liquid crystal display unit 3 comprises a display housing 20, and a liquid crystal panel 21 contained in the display housing 20. An opening 22 for display is formed in the front wall of the display housing 20. The opening 22 has a size equivalent to a majority of the front wall. The screen of the liquid crystal panel 21 is exposed to the outside of the display housing 20 through the opening 22.

The display housing 20 includes a pair of leg portions 23*a*, 23*b* at one end portion. The leg portions 23*a*, 23*b* are spaced part from each other in the width direction of the display housing 20, and respectively extend to the display supporting portions 16*a*, 16*b* of the housing 10. These leg portions 23*a*, 23*b* are rotatably supported by the rear end portion of the housing 10 via respective hinge members (not shown).

Figure 2:
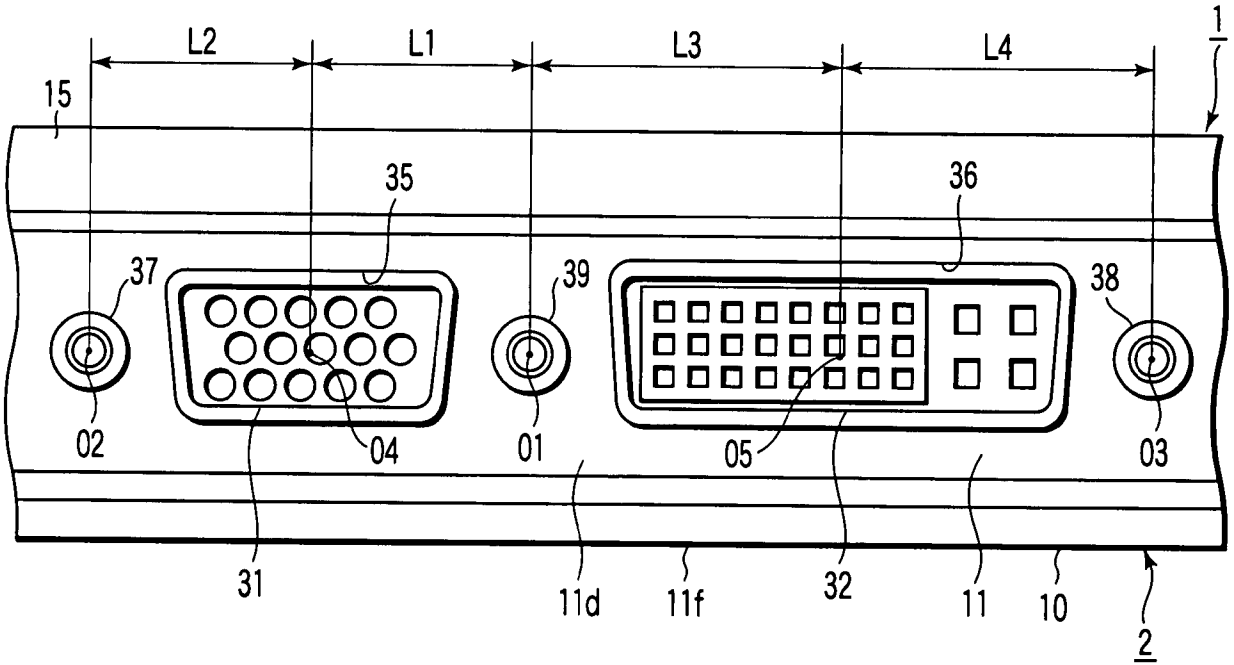
FIG. 2 is an exemplary rear view showing the portable computer of FIG. 1.

Thus, the liquid crystal display unit 3 is rotatable between a closed position in which the liquid crystal display unit 3 is tilted to cover the palm rest 12 and the keyboard 14 from the above, and an open position in which the liquid crystal display unit 3 is stood up to expose the palm rest 12 and the keyboard 14. FIG. 1 shows the portable computer 1 in the closed position. FIG. 2 shows the portable computer 1 in the open position.

A printed wiring board (not shown) is contained in the housing 10. The printed wiring board is placed below the keyboard 14 and is secured to the bottom wall 11*f* of the housing 10 with screws.

As shown in FIGS. 2 to 5, the first connector 31 and the second connector 32 are provided to the housing 10. The first connector 31 and the second connector 32 are mounted to the connector panel 11*d* such that they are adjacent to each other. In FIGS. 2 to 5, the first connector 31 is located on the left of the second connector 32. In other words, in FIGS. 2 to 5, the second connector 32 is located on the right of the first connector 32. For this embodiment, the first connector 31 and the second connector 32 are female. The first connector 31 and the second connector 32 are electrically connected to the printed wiring board.

A first opening 35, for exposing the first connector 31 to the outside of the housing 10, is provided in the connector panel 11*d* at a position facing the first connector 31. A second opening 36, for exposing the second connector 32 to the outside of the housing 10, is provided in the connector panel 11*d* at a position facing the second connector 32. The first connector 31 and the second connector 32 mounted to the connector panel 11*d* are contained in the housing 10 such that they are exposed to the outside of the housing 10 through the connector panel 11*d* (the first opening 35 and the second opening 36 of the connector panel 11*d*).

External apparatuses, for example, those having the same function but different types of connecting portions are connected to the connectors 31, 32. Hence, in this portable computer 1, it is a prerequisite that the first connector 31 and the second connector 32 are not concurrently used.

In the embodiment, connectors, for example, those that output image signals are used as the first and second connectors 31, 32. More specifically, one of the first and second connectors 31, 32, for example, the first connector 31, is a connector that outputs analog signals, and the second connector 32, which is the other connector, is a connector that outputs digital signals. An RGB connector can be used as such a first connector 31. A DVI connector can be used as such a second connector 32. Alternatively, a connector that outputs digital signals (for example, a DVI connector) and a connector that outputs analog signals (for example, an RGB connector) may be used as the first connector 31 and the second connector 32, respectively. Note that in this portable computer 1, the first connector 31 and the second connector 32 are formed as a single piece, thereby physically connected together and forming a single connector element.

A male first plug 33*a* (refer to FIGS. 3 and 4) of the first cable 33 can be removably connected to the first connector 31. A male second plug 34*a* (refer to FIG. 5) of the second cable 34 can be removably connected to the second connector 32. FIG. 1 shows the state where the first plug 33*a* of the first cable 33 is connected to the first connector 31. In this portable computer 1, an RGB cable having a male RGB plug is used as the first cable 33. A DVI cable having a male DVI plug is used as the second cable 34.

Figure 3:
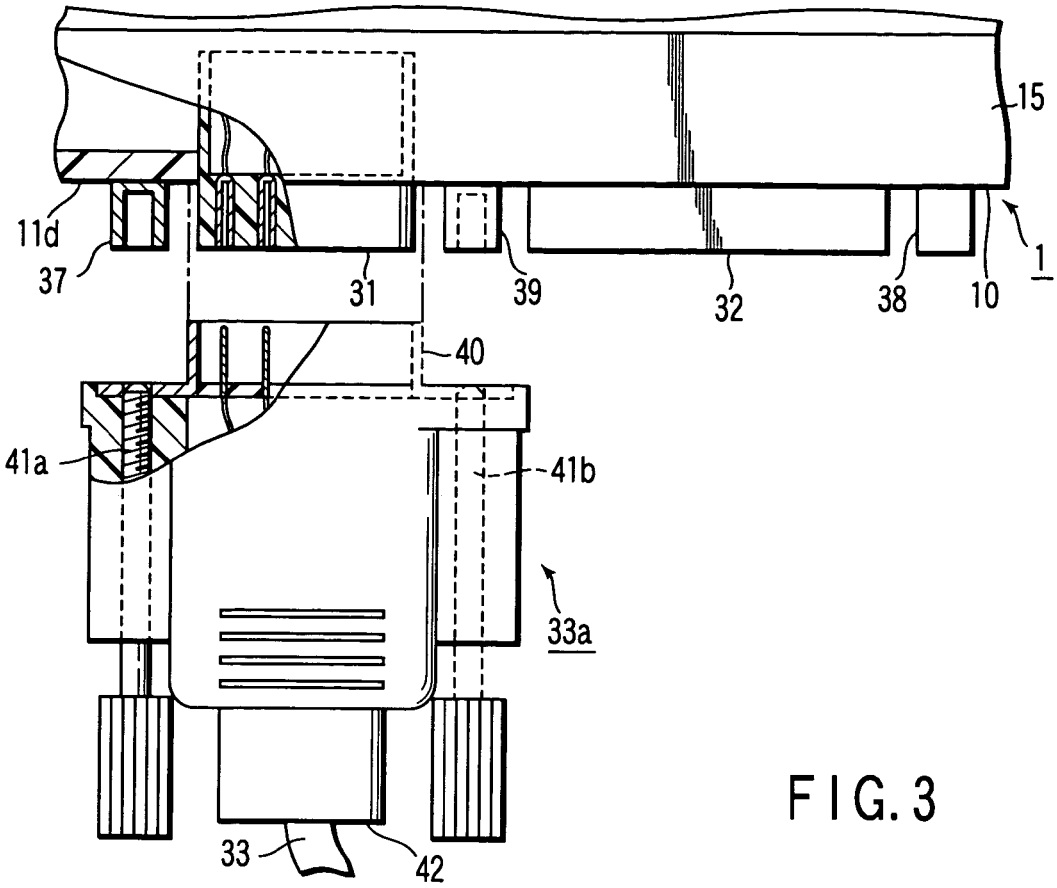
FIG. 3 is a top view showing part of the portable computer of FIG. 1 and part of a first connector cable.
Figure 4:
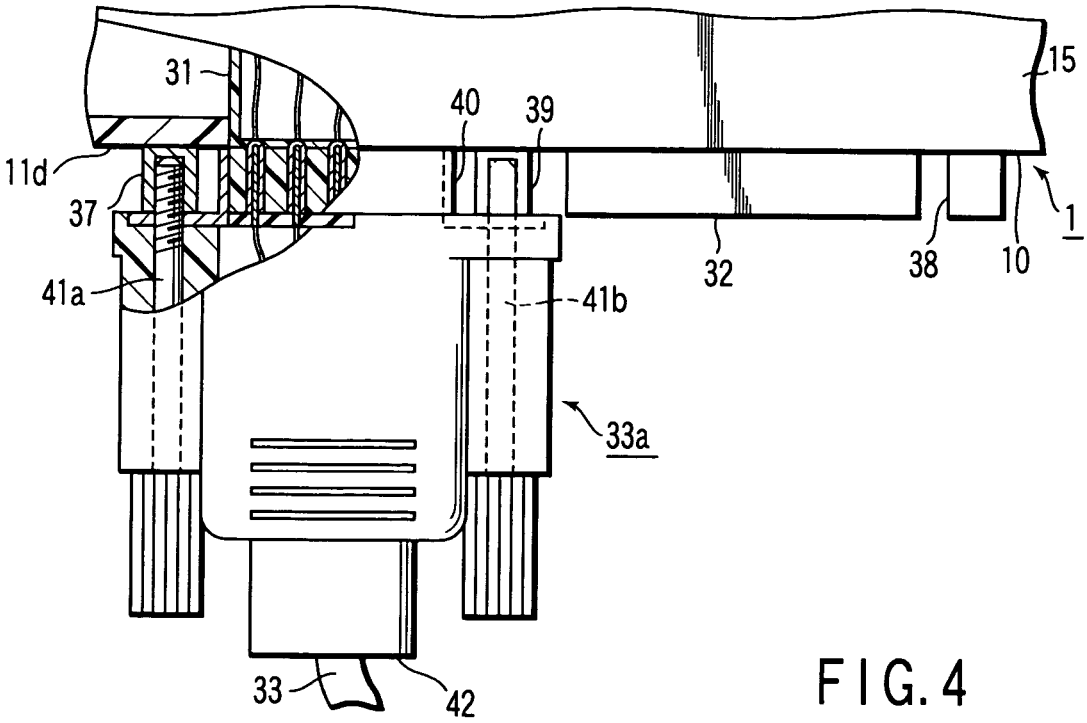
FIG. 4 is a top view showing the state where the first connector, part of which is omitted, is connected to the portable computer, part of which is omitted, of FIG. 1.

The first plug 33*a* includes a plug body 40, a pair of screws 41*a*, 41*b*, as a pair of fixing members, and a casing 42 (refer to FIGS. 3 and 4). Likewise, the second plug 34*a* 2 includes a plug body 43, a pair of strews 44*a*, 44*b*, as a pair of fixing members, and a casing 45 (refer to FIG. 5). That is to say, when connecting the plugs 33*a*, 34*a* to their respective corresponding connectors 31, 32, both of the plugs 33*a*, 34*a* are screwed to the housing 10 (such as the connector panel 11*d*, as the outer wall of the housing 10, or the connectors 31, 32 mounted to the connector panel 11*d*). Hence, as shown in FIGS. 2 to 5, the housing 10 is provided with screw bosses 37, 38 and 39 as receiving elements.

In this portable computer 1, when connecting the first plug 33*a* to the first connector 31, the first plug 33*a* is screwed to the housing 10 using the first screw boss 37 and the third screw boss 39. When connecting the second plug 34*a* to the second connector 32, the second plug 34*a* is screwed to the housing 10 using the second screw boss 38 and the third screw boss 39.

The first screw boss 37 is provided to the connector panel 11*d* of the housing 10 such that it is positioned on the side (the left side in FIGS. 2 to 5) of the first connector 31 opposite to the side on which the second connector 32 is provided. The first screw boss 37 is exposed to the outside of the connector panel 11*d*. The first screw boss 37 is provided at a position where, among the pair of screws 41*a*, 41*b*, the screw 41*a* on the side (on the left side in FIGS. 2 to 5) opposite to the side on which the second connector 32 is provided, is screwed in, when connecting the first plug 33*a* to the first connector 31.

The second screw boss 38 is provided to the connector panel 11*d* of the housing 10 such that it is positioned on the side (the right side in FIGS. 2 to 5) of the second connector 32 opposite to the side on which the first connector 31 is provided. The second screw boss 38 is exposed to the outside of the connector panel 11*d*. The second screw boss 38 is provided at a position where, among the pair of screws 44*a*, 44*b*, the screw 44*a* on the side (the right side in FIGS. 2 to 5) opposite to the side on which the first connector 31 is provided, is screwed in, when connecting the second plug 34*a* to the second connector 32.

The third screw boss 39 is provided to the connector panel 11*d* of the housing 10 such that it is positioned between the first connector 31 and the second connector 32. The third screw boss 39 is exposed to the outside of the connector panel 11*d*. The third screw boss 39 is provided at a position where, among the pair of screws 41*a*, 41*b*, the other screw 41*b* on the side (the right side in FIGS. 2 to 5) on which the second connector 32 is provided, is screwed in, when connecting the first plug 33*a* to the first connector 31, and where, among the pair of screws 44*a*, 44*b*, the other screw 44*b* on the side (the left side in FIGS. 2 to 5) on which the first connector 31 is provided, is screwed in, when connecting the second plug 34*a* to the second connector 32. The screw bosses 37, 38, 39 protrude from the outer surface of the housing 10.

The first to third screw bosses 37, 38, 39, and the first and second connectors 31, 32, may all be in one piece. In that instance, for example, openings are formed to expose the first to third screw bosses 37, 38, 39, in the connector panel 11*d* and expose the first to third screw bosses 37, 38, 39 to the outside of the housing 10 through the connector panel 11*d*.

Figure 5:
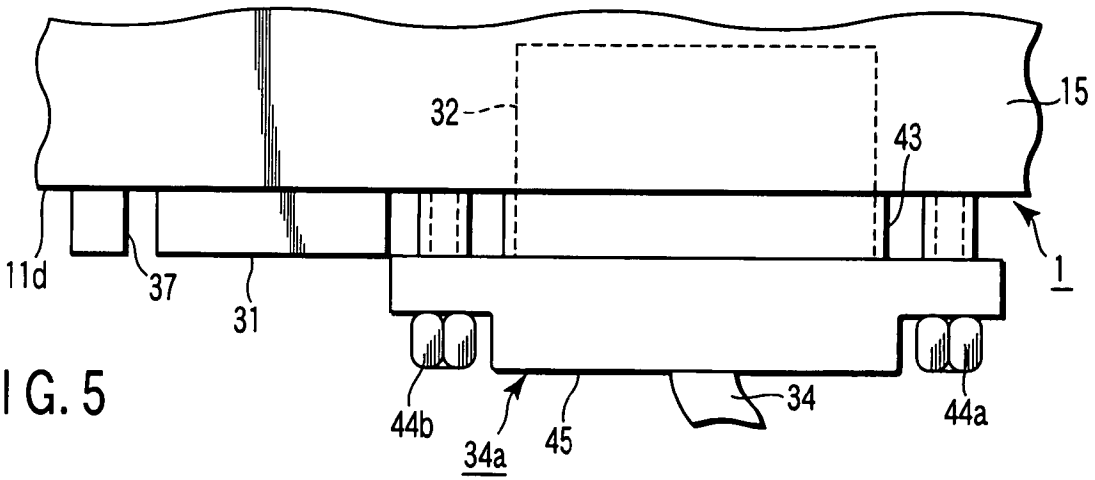
FIG. 5 is a top view showing the state where a second connector is connected to the portable computer of FIG. 1.

In the embodiment, each of the plugs 33*a*, 34*a* has a symmetrical outer shape, as shown in FIGS. 3 to 5. In that instance, the first, second and third screw bosses 37, 38, 39 are positioned such that the distance L1 between the center O1 of the third screw boss 39 and the center O4 of the first connector 31 equals the distance L2 between the center O2 of the first screw boss 37 and the center O4 of the first connector 31, and the distance L3 between the center O1 of the third screw boss 39 and the center O5 of the second connector 32 equals the distance L4 between the center O3 of the second screw boss 38 and the center O5 of the second connector 32, as shown in FIG. 2.

The above-described portable computer 1 permits connection of either an external apparatus that receives analog image signals and display images, or an external apparatus that receives digital image signals and display images, as an extension apparatus.

When an external apparatus that receives analog image signals and displays images is to be used, an analog external device that displays images (not shown) is connected to the first connector 31 via the first cable 33, as shown in FIGS. 3 and 4. In doing so, the first plug 33*a* is secured to the housing 10 with the screws 41*a*, 41*b*, using the first screw boss 37 and the third screw boss 39. Thus, the first plug 33*a* is fixed to the housing 10.

On the other hand, when an external apparatus that receives digital image signals and displays images is to be used, a digital external apparatus that displays images (not shown) is connected to the second connector 32 via the second cable 34, as shown in FIG. 5. In doing so, the second plug 34*a* is secured to the housing 10 with the screws 44*a*, 44*b*, using the second screw boss 38 and the third screw boss 39. Thus, the second plug 34*a* is secured to the housing 10.

As described above, the portable computer 1 of this embodiment includes the first screw boss 37, as the first receiving element that fixes (screws together with) one screw 41*a* among the pair of screws 41*a*, 41*b* of the first plug 33*a*; the second screw boss 38, as the second receiving element that fixes (screws together with) one screw 44*a* among the pair of screws 44*a*, 44*b* of the second plug 34*a*; and the third screw boss 39, as the third receiving element that fixes (screws together with) either the other screw 41*b* among the pair of screws 41*a*, 41*b* of the first plug 33*a* or the other screw 44*b* among the pair of screws 44*a*, 44*b* of the second plug 34*a* at a time.

Hence, when connecting the first plug 33*a* to the first connector 31, the first plug 33*a* can be fixed to the housing 10 using the first screws boss 37 and the third screw boss 39. On the other hand, when connecting the second plug 34*a* to the second connector 32, the second plug 34*a* can be fixed to the housing 10 using the second screw boss 38 and the third screw boss 39.

In other words, in the embodiment, only one screw boss 39 is provided between the connectors 31, 32, and the screw 39 is used for fixing both the first plug 33*a* and the second plug 34*a* to the housing 10 or the connectors 31, 32. Therefore, the space between the first connector 31 and the second connector 32 can be made smaller than before. In other words, the first connector 31 and the second connector 32 can be placed at a higher density than before, and consequently, the space occupied by the connectors can be reduced.

In addition, as a result of that, the portable computer 1 can be made smaller without reducing the number of mounted connectors or, alternatively, the number of mounted connectors can be increased without making the portable computer 1 larger.

Moreover, in the portable computer 1, the first connector 31 is one piece with the second connector 32. Hence, the assembly, when these connectors 31, 32 are mounted to the housing 10, is easy.

Note that the first connector 31 and the second connector 32 may be separate pieces. In that instance, already available connectors can be used, without any modification, as the first connector 31 and the second connector 32.

In the present invention, the fixing members and the receiving elements are not limited to screws and screw bosses. There is, for example, a kind of plugs that printer cables, etc., have, which are provided with engagement elements as fixing members. In that instance, the first to third screw bosses 37, 38, 39 can be replaced with first to third engagement members, for example, clip-like first to third engagement metal members, and use them instead as the receiving elements. If the first connector 31 and the second connector 32 are to be mounted to the inner surface of the connector panel 11*d*, as in the present embodiment, the first to third engagement members are provided to the outer surface of the connector panel 11*d* or to the connectors 31, 32 such that they are exposed to the outside of the housing 10.

Further, in the present invention, the first connector 31 and the second connector 32 are not limited to the connectors used in the embodiment. The first connector 31 and the second connector 32 are applicable not only to connectors that output image signals but also to various connectors. In addition, in the present invention, the first connector 31 and the second connector 32 may both be connectors that output analog signals, or alternatively, digital signals, although in the embodiment, one of the first and second connectors 31, 32 is a connector that outputs analog signals and the other one of the first and second connectors 31, 32 is a connector that outputs digital signals.

In the embodiment, the first connector 31 and the second connector 32 are mounted to the connector panel 11*d*, which serves as the rear wall of the outer wall 11 of the housing 10. However, it is contemplated that the first connector 31 and the second connector 32 do not necessarily need to be mounted to the connector panel 11*d*.

The electronic apparatus according to the present invention is not limited to a portable computer with a keyboard and a display unit. The present invention can be implemented in the same manner also in, for example, a pen-input type computer that uses a tablet instead of a keyboard. Therefore, while certain exemplary embodiments of the invention have been described and shown in the accompanying drawings, it is to be understood that such embodiments are merely illustrative of and not restrictive on the broad aspects of various embodiments of the invention.

What is claimed is:

1. An electronic apparatus comprising:

a housing;

a first connector provided to the housing, the first connector adapted to receive a first plug, including a pair of fixing members, that is removably connected to the first connector;

a second connector provided to the housing and adjacent to the first connector, the second connector adapted to receive a second plug, including a pair of fixing members that is removably connected to the second connector;

a first receiving element provided to the housing on a side of the first connector opposite to a side on which the second connector is provided, a second receiving element provided to the housing on a side of the second connector opposite to a side on which the second connector is provided, and a third receiving element provided to the housing between the first connector and the second connector, wherein the first and third receiving elements to receive the pair of fixing members of the first plug when the first plug is connected to the first connector, and the second receiving element and the third receiving element to receive the pair of fixing members of the second plug when the second plug is connected to the second connector.

2. The electronic apparatus according to claim 1, wherein the first, second and third receiving elements are positioned such that a distance between a center of the third receiving element and a center of the first connector is substantially equal to a distance between a center of the first receiving element and the center of the first connector, and a distance between the center of the third receiving element and a center of the second connector is substantially equal to a distance between a center of the second receiving element and the center of the second connector.

3. The electronic apparatus according to claim 1, wherein the first and second connectors are connectors that output image signals.

4. The electronic apparatus according to claim 1, wherein one of the first and second connectors is a connector that outputs analog signals, and another one of the first and second connectors is a connector that outputs digital signals.

5. The electronic apparatus according to claim 1, wherein the first receiving element is a screw boss.

6. An electronic apparatus comprising:

a housing having an outer wall;

a first connector contained in the housing and exposed to the outside through the outer wall, the first connector adapted to receive a first plug, including a pair of screws, that is removably connected to the first connector;

a second connector contained in the housing adjacent to the first connector and exposed to the outside through the outer wall, the second connector adapted to receive a second plug, including a pair of screws that is removably connected to the second connector;

a first screw boss positioned on a side of the first connector opposite to a side on which the second connector is provided, the first screw boss being exposed through the outer wall a second screw boss positioned on a side of the second connector opposite to a side on which the first connector is provided, the second screw boss being exposed through the outer wall; and a third screw boss positioned between the first connector and the second connector, the third screw boss being exposed through the outer wall wherein the first screw boss and the third screw boss receive the pair of screws of the first plug when the first plug is connected to the first connector, and the second screw boss and the third screw boss receive the pair screws of the second plug when the second plug is connected to the second connector.

7. The electronic apparatus according to claim 6, wherein the first and second connectors are connectors that output image signals.

8. The electronic apparatus according to claim 6, wherein one of the first and second connectors is a connector that outputs analog signals, and another one of the first and second connectors is a connector that outputs digital signals.

9. The electronic apparatus according to claim 6, wherein the first connector and the second connector are physically connected together and form a single connector element.

10. An electronic apparatus comprising:

a housing including a connector panel;

a first connector mounted to the connector panel, the first connected adapted to receive a first plug, including a pair of engagement elements, that is removably connected to the first connector;

a second connector mounted to the connector panel, the second connector adapted to receive a second plug, including a pair of engagement elements, that is removably connected to the second connector;

a first engagement member provided to the connector panel on aside of the first connector opposite to a side on which the second connector is provided;

a second engagement member provided to the connector panel on a side of the second connector opposite to a side on which the first connector is provided; and a third engagement member provided to the connector panel between the first connector and the second connector, wherein the first engagement member and the third engagement member receive the pair of engagement elements of the first plug when the first plug is connected to the first connector, and the second engagement member and the third engagement member receive the pair of engagement elements when the second plug is connected to the second connector.

11. The electronic apparatus according to claim 10, wherein the first and second connectors are connectors that output image signals.

12. The electronic apparatus according to claim 10, wherein one of the first and second connectors is a connector that outputs analog signals, and another one of the first and second connectors is a connector that outputs digital signals.

13. The electronic apparatus according to claim 10, wherein the first connector and the second connector are physically connected together and form a single connector element.

14. An electronic apparatus comprising:

a housing including a side wall having a plurality of openings;

a first connector to which a first plug having a fixing member is connected, the first connector protruding from a first opening of the plurality of openings;

a second connector to which a second plug having a fixing member is connected, the second connector protruding from a second opening of the plurality of openings; and a plurality of receiving elements having a single receiving element positioned on each side of the first connector and the second connector so that only one receiving element is positioned between the first connector and the second connector, wherein a receiving element positioned between the first connector and the second connector receives the fixing member of the first plug when the first plug is connected to the first connector, and the receiving element receives the fixing member of the second plug when the second plug is connected to the second connector.

15. The electronic apparatus according to claim 14 is a portable computer.

16. The electronic apparatus according to claim 14, wherein a third receiving element of the plurality of receiving elements is positioned such that a distance between the third receiving element and a center of the first connector is substantially equal to a distance between a receiving element of the plurality of receiving elements and the center of the first connector, and a distance between the third receiving element and a center of the second connector is substantially equal to a distance between a second receiving element of the plurality of receiving elements and the center of the second connector.

17. The electronic apparatus according to claim 14, wherein the first connector to output analog signals and the second connector to output digital signals.

* * * * *